United States Patent [19]

Eyre

[11] Patent Number: 4,512,594

[45] Date of Patent: Apr. 23, 1985

[54] SAFETY SKI BINDING

[76] Inventor: Steven C. Eyre, P.O. Box 2348, Taos, N. Mex. 87571

[21] Appl. No.: 528,347

[22] Filed: Aug. 31, 1983

[51] Int. Cl.[3] ..... A63C 9/08

[52] U.S. Cl. ..... 280/614; 280/628

[58] Field of Search ..... 280/614, 615, 618, 629, 280/630, 628

[56] References Cited

U.S. PATENT DOCUMENTS

| | | | |
|---|---|---|---|
| 3,870,326 | 3/1975 | Cubberley | 280/628 |
| 4,029,336 | 6/1977 | Haimerl | 280/614 |
| 4,269,430 | 5/1981 | Eie | 280/614 |
| 4,273,354 | 6/1981 | George | 280/614 |

FOREIGN PATENT DOCUMENTS

| | | | |
|---|---|---|---|
| 2657257 | 6/1978 | Fed. Rep. of Germany | 280/614 |
| 607433 | 8/1960 | Italy | 280/614 |

*Primary Examiner*—David M. Mitchell
*Assistant Examiner*—Michael Mar
*Attorney, Agent, or Firm*—Robert W. Harris

[57] ABSTRACT

Safety ski binding for use in both downhill and cross-country skiing. A conventional 3-pin 75 mm. toe binding is mounted on a front base plate which is rotatable during downhill skiing, but is locked against rotation for cross-country skiing. The rear binding assembly employs a reversed Cubco toe binding used as a heel binding, which is locked to a heel latch assembly during downhill skiing, the heel latch being unlocked during cross-country skiing. In downhill skiing a safety release occurs by overcoming the spring compression of the Cubco binding, and such release is facilitated by the rotation of the ski boot about the axis of the front base plate. During cross-country skiing the heel latch is unlocked, and the heel of the ski boot is free to move vertically above the ski.

8 Claims, 8 Drawing Figures

SAFETY SKI BINDING

BACKGROUND OF THE INVENTION

The invention pertains to safety ski bindings, and more particularly to ski bindings facilitating both horizontal and vertical safety release, for both cross-country and downhill skiing.

Many skiers are injured in falls during skiing, because in such falls skiers' legs are often subjected to violent torques, resulting from the fact that the skier's body is tumbling, while the skis are restrained from free tumbling motion by collision with the ground. Such torques frequently result in broken bones, or at least in torn ligaments.

The general approach to this problem has been to employ ski bindings having safety release features, intended to release the ski boot from the ski during a fall, so as to prevent such injuries.

The problem is, however, complicated by the fact that a variety of relative horizontal and vertical motions (of the ski boot and the ski) are involved in various skiing activities. Different relative motions are involved in cross-country skiing, than are involved in downhill skiing.

It is desirable to provide a combined front (toe) and rear (heel) ski binding of simple construction, in which both the front and rear bindings have release motion capability, and in which the release motions of the front and rear bindings cooperate, so as to provide for either horizontal, vertical, or oblique release of the ski boot, as appropriate, for use in either cross-country or downhill skiing situations.

Appliant's invention deals with this problem, by providing a front binding assembly which is rotatable for downhill skiing, but which may be locked against rotation for cross-country skiing. The rear binding assembly has a reversed but otherwise conventional "Cubco" type front binding, secured to a heel latch assembly on the ski boot, the latch being open during cross-country skiing to allow vertical release of the ski boot, and being locked during downhill skiing; however, the reversed "Cubco" binding will allow either vertical or horizontal release during downhill skiing, and horizontal release is facilitated by the allowed rotation of the front binding.

The patent of Marks (U.S. Pat. No. 4,188,045) discloses a safety ski binding having a base plate which rotates about a disk secured to the ski (col 2, lines 30–35; FIG. 1, ref. Nos. 1 and 3). The patent discloses a complex mechanism unlike that of applicant, for locking the base plate against rotation, involving a bar with a detent recess, engaged by a pin driven by leaf springs (col. 2, lines 35–42; FIG. 1, ref. Nos. 5, 6 and 7). The structure disclosed in Marks is more complex and quite different than applicant's in other respects, involving a boot carrier frame and a spring-loaded cable and winder assembly, unlike applicant's ski binding (FIG. 1, ref. Nos. 12, 22 and 23; col 2, line 51—col 3, line 26). Also the base plate rotates about a point near the heel of the ski boot, rather than the toe as in applicant's ski binding (FIG. 1, ref. Nos. 3 and 19; col 1, line 6; col 2, line 66).

The patent of Whitaker (U.S. Pat. No. 2,686,059) discloses a safety ski binding having a rotatable heel plate, which is not, however, attached to the ski itself, but rather to a cross bar attached to hinged arms secured to the ski (col 2, lines 38–48; FIGS. 7–8, ref. Nos. 23, 27, 28, 29 and 31). The structure is generally quite different and more complex than applicant's, involving a wire cable and a toggle activated tensioning and release mechanism (col. 2, lines 28–33; FIG. 7, ref. Nos. 19, 21 and 22).

Applicant is not aware of any patent or other prior art disclosing a ski binding comparable to that of his invention, which is further described below.

SUMMARY OF THE INVENTION

The present invention is a combined front and rear safety ski binding, providing vertical, horizontal and oblique release, for use in both cross-country and downhill skiing.

The front binding assembly comprises a conventional 3-pin 75 mm. toe binding mounted upon a front base plate which is rotatably secured to the ski, the front base plate having a hole which snugly engages a round disk securely attached to the ski, thus allowing the front base plate and toe binding to rotate about the center of the disk during downhill skiing. The front binding assembly is provided with a screw lock with which the front base plate may be secured to the ski to prevent such rotation, this screw lock being engaged during cross-country skiing.

The rear binding assembly comprises a conventional "Cubco" toe binding which is reversed and used as a heel binding, together with a heel latch assembly which is attached to the heel of the ski boot. The heel latch assembly is used to secure the heel to the heel binding during downhill skiing, but is disengaged during cross-country skiing. The heel latch assembly has a heel plate, bent at right angles to an L-shaped cross section, the lower (horizontal) portion of the heel plate being attached to the bottom of the heel of the ski boot. The vertical section of the heel plate, located just behind the heel of the ski boot, has a vertical opening for receiving the forward end of the "Cubco" binding, and has a rotatable latch for securing the forward end of the "Cubco" binding within the opening during downhill skiing.

During downhill skiing, the forward end of the "Cubco" binding is secured to the heel plate, but a safety release is still possible, in either the horizontal or vertical directions, when the forces involved are sufficient to overcome the spring compression of the "Cubco" binding. A horizontal release is facilitated because the front binding assembly is free to rotate, the screw lock being disengaged.

During cross-country skiing the latch of the heel binding assembly is disengaged, thus allowing vertical release of the ski boot heel.

One object of the present invention is to provide a ski binding of simple construction affording safety release capability for both the front and rear portions of the ski binding.

Another object of the present invention is to provide a ski binding in which the safety release motions of the front and rear portions of the ski binding cooperate to facilitate safe release of the ski boot during downhill skiing.

Another object of the present invention is to provide a ski binding in which the safety release meachanisms are adjustable for use in either downhill or cross-country skiing activities.

DESCRIPTION OF THE PREFERRED EMBODIMENT

Figure 1:
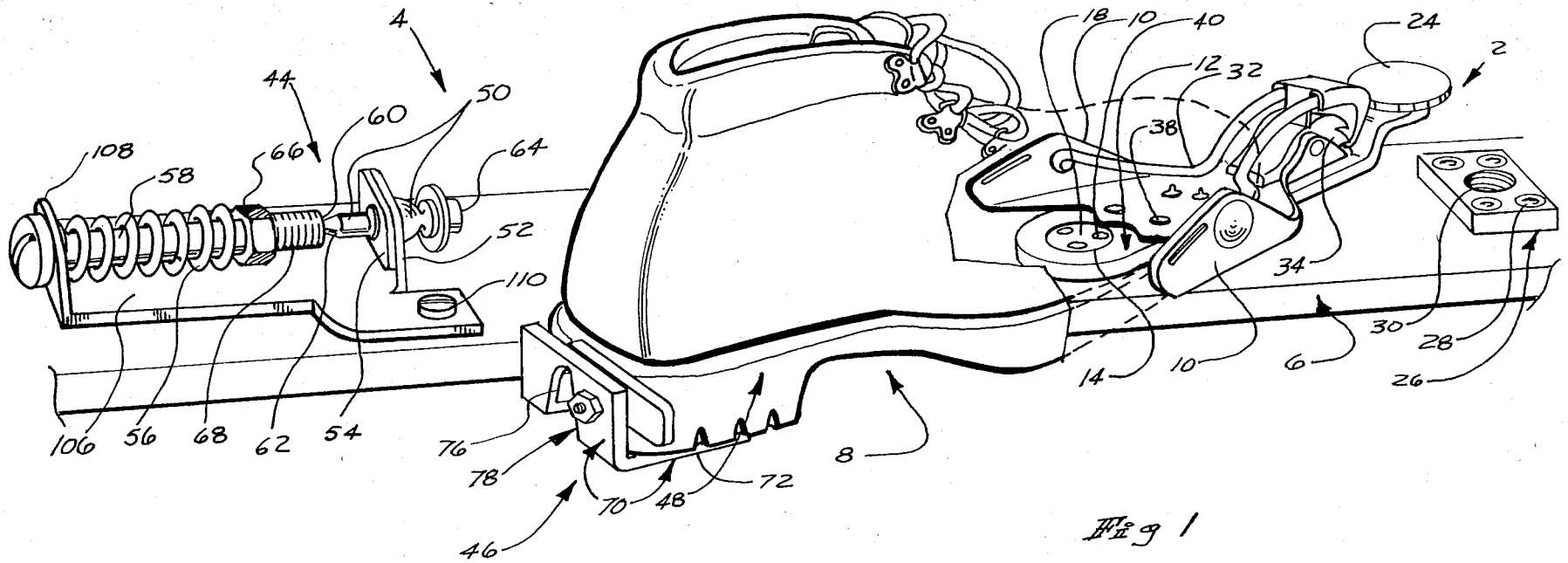
FIG. 1 is perspective view of the present ski binding with a ski boot, during a horizontal safety release occurring in the downhill skiing configuration, with the forward portion of the ski boot cut away to show details of structure of the front binding assembly.

Turning now to the drawings, wherein like reference numbers denote like or corresponding parts, the front binding assembly 2 and rear binding assembly 4 of the present invention are shown attached to the ski 6, and securing a ski boot 8.

The front binding assembly 2 comprises a toe binding 10; a front base plate 12, to which the toe binding 10 is attached, which front base plate 12 has a circular hole 14 in the rear portion thereof and a raised forward portion 16; a disk 18 which is attached to the ski 6 and which is of a diameter which snugly fits within the hole 14 in the front base plate 12; and a screw lock 20. The screw lock 20 comprises a screw 22 having a hand-tightened head 24, the screw 22 passing through a hole in the raised forward portion 16 of the front base plate 12; and a lock plate 26 attached to the ski 6 by screws 28, the lock plate 26 having a threaded hole 30 with threads matching those of the screw 22.

The toe binding 10 is, in the preferred embodiment, a conventional 3-pin 75 mm. "Nordic Norm" toe binding, having a clamp 32 and a spring latch 34 adapted to clamping the forward portion of the sole 36 of the ski boot 8, so as to hold the ski boot 8 fixed with respect to the front base plate 12. The toe binding 10 is attached to the front base plate 12 by screws 38 inserted through appropriate holes in the base of the toe binding 10 and into matching threaded holes in the front base plate 12.

The front base plate 12 is free to rotate with respect to the ski 6, when the screw lock 20 is disengaged, by rotation of the front base plate 12 about the axis of the disk 18 which snugly fits the hole 14 in the front base plate 12. However, the front base plate 12 is securely attached to the ski 6. That is to say, the front base plate 12 is secured against being lifted vertically off of the disk 18 and the ski 6. This is most easily acccomplished by making the edges of the disk 18 and the hole 14 canted, with diameter increasing toward the top. The disk 18 is securely attached to the ski 6 by screws 40, and secures the front base plate 12 to the ski 6, since, because of the above-described canted edges, the diameter of the top of the disk 18 exceeds the diameter of all portions of the hole 14 below the top of the hole 14.

However, there are numerous other equivalent means by which the front base plate 12 could be secured against vertical motion with respect to the ski 6. For example, the disk 18 could be made slightly thicker than the front base plate 12, and with a diameter at the top slightly exceeding that of the hole 14 in the front base plate 12, thus forming a lip around the upper circumference of the disk 18, which lip would engage the upper edges of the hole 14 in the front base plate 12, thus preventing vertical motion of the front base plate 12 when the disk 18 is attached to the ski 6.

Those familiar with the art will appreciate that the above-described arrangements involving the disk 18 and hole 14 merely constitute one particular rotation means for securing the front base plate 12 to the ski 6, and for allowing rotation of the front base plate 12 about an axis perpendicular to the surface of the ski 6. Numerous other means could be used to accomplish the same ends. For example, a short vertical axis rigidly attached to the ski 6 could be secured to the center of a bearing mounted in a hole in the front base plate 12.

Those familiar with the art will appreciate that the screw lock 20 merely constitutes a particular means for locking the front base plate 12 against rotation about the center of the disk 18, with the front base plate 12 aligned parallel to the longitudinal axis 42 of the ski 6, and that numerous other means could be used to accomplish the same purpose. For example, the front base plate 12 could be made with a notch in the forward edge thereof, and a short pin with a threaded end could be inserted through the notch into the threaded hole 30 in the lock plate 26.

The rear binding assembly 4 comprises a heel binding 44, and a heel latch assembly 46 which is secured to the heel 48 of the ski boot 8.

Figure 2:
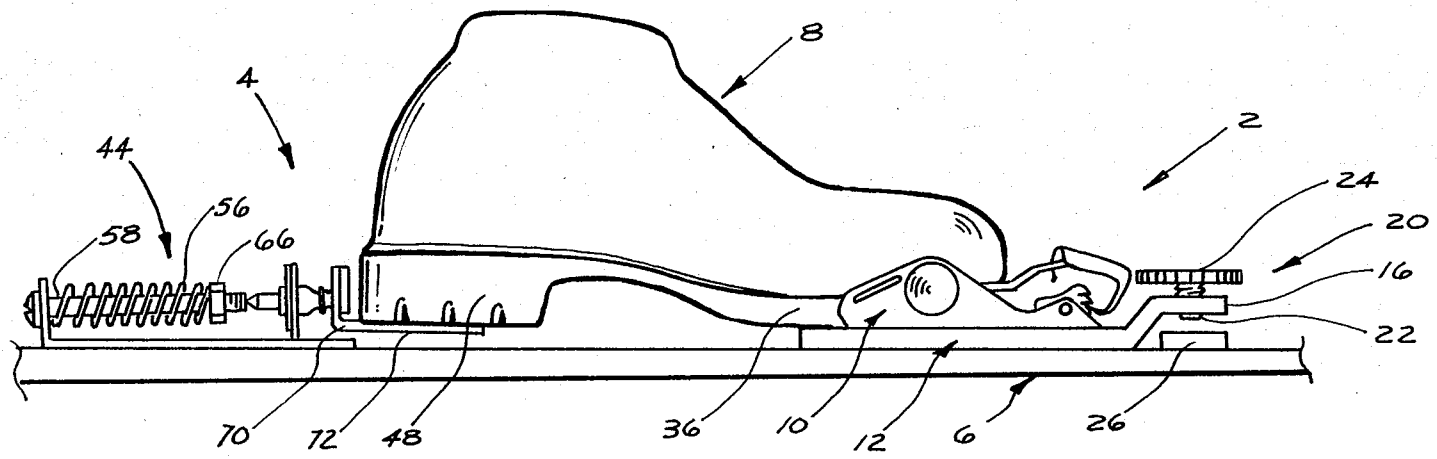
FIG. 2 is a side elevational view, also in the downhill skiing configuration, prior to release, with the latch of the heel latch assembly engaged, and the screw lock of the front binding assembly disengaged.
Figure 3:
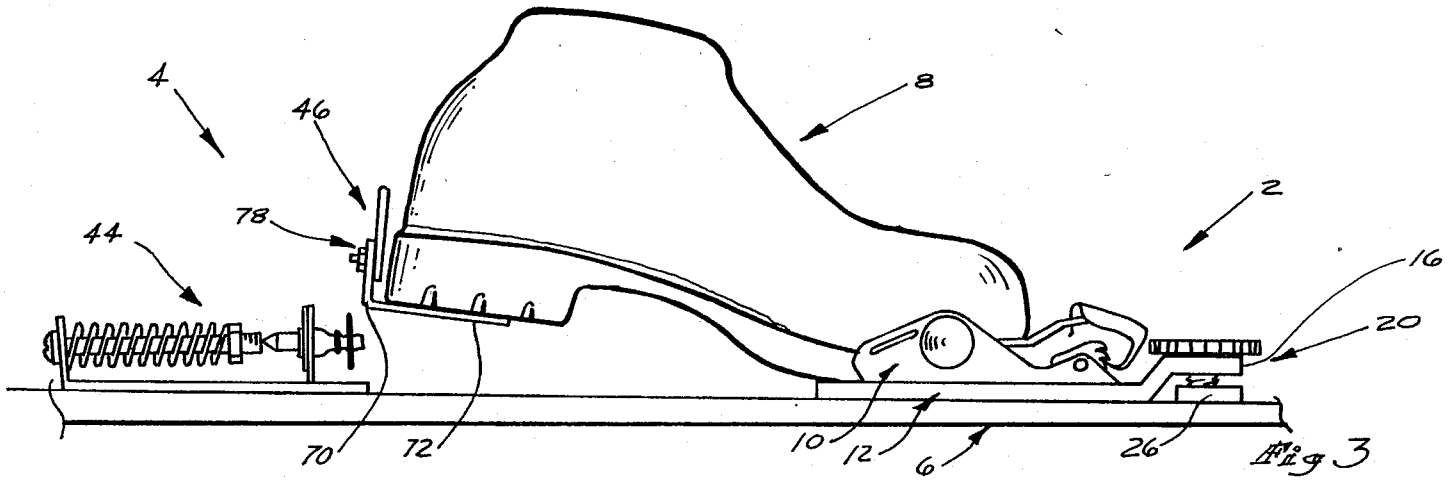
FIG. 3 is a side elevational view in thecross-country skiing configuration, with the latch of the heel latch assembly disengaged and the screw lock of the front binding assembly engaged, showing the heel of the ski boot raised vertically above the ski.

The heel binding 44 is a conventional "Cubco" type toe binding which is reversed from its normal configuration as a toe binding, and used instead in the orientation shown in FIGS. 1–3. In the heel binding 44, the member 50 passes through a hole in the brace 52, and has a positioning plate 54 rigidly attached to member 50. Positioning plate 54 is normally held flat against the brace 52, by the tension of the spring 56 urging the bolt 58, which has a concave end 60, against the point 62 of the member 50. In this manner the member 50 is normally held with its longitudinal axis parallel to the ski 6. However, if sufficient transverse (horizontal, vertical, or oblique) force is applied to the other end 64 of the member 50, the tension of the spring 56 may be oversome, so that the member 50 is rotated from the longitudinal configuration, with the point 62 of the member 50 rotating within the concave end 60 of the bolt 58. This release is adjustable by adjustment of the compression in spring 56, through movement of a nut 66 on threads 68 of bolt 58.

Figure 5:
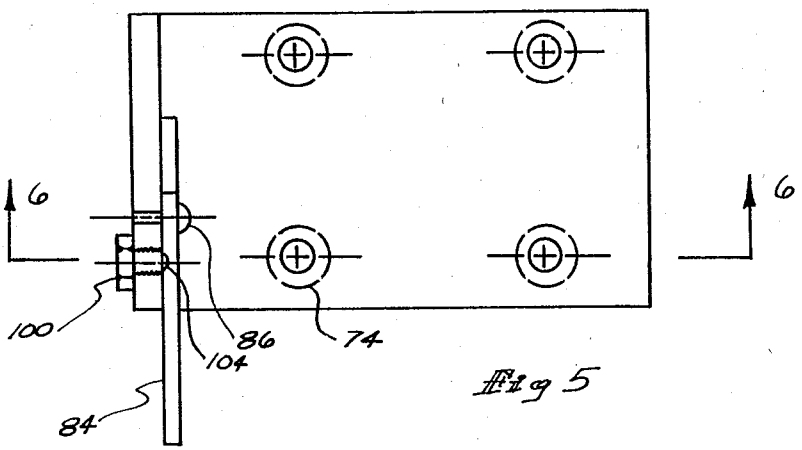
FIG. 5 is a sectional view of the heel plate and latch, in the direction indicated by the line 5—5 in FIG. 4, with the latch in the locked position.
Figure 6:
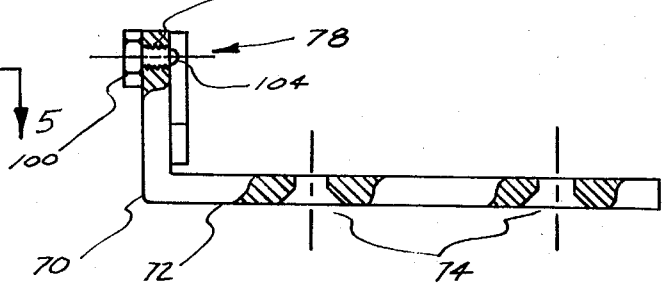
FIG. 6 is a sectional view of the lower portion of the heel plate, in the direction 6—6 indicated in FIG. 5.
Figure 4:
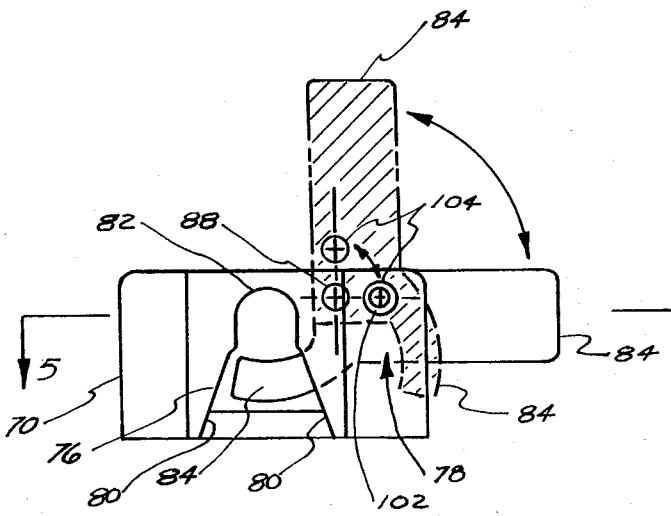
FIG. 4 is a rear view of the heel plate, opening and latch of the heel latch assembly, showing the unlocked (cross-hatched) and locked positions of the latch.

As best seen in FIGS. 4–6, the heel latch assembly 46 comprises a heel plate 70, bent at right angles into an L-shaped cross section, with the bottom section 72 of the heel plate 70 being attached to the bottom of the heel 48 of the ski boot 8 by screws inserted through holes 74, the heel plate 70 having an aperture 76; and a heel latch mechanism 78.

The ski boot 8 is connected to the heel binding 44 by bringing the heel 48 of the ski boot 8 down onto the ski in such position that the aperture 76 receives the end 64 of member 50, and latching the heel latch mechanism 78. The aperture 76 in the heel plate 70 has a triangular shaped lower portion 80, adapted to center the aperture 76 with respect to the end 64 of member 50 of the heel binding 44, and a central upper arch shaped portion 82, which receives the end 64 of member 50 when the heel 48 of ski boot 8 is placed upon the ski 6. The radius of the arch of portion 82 is sufficiently larger than that of the end 64 of member 50, to allow release of end 64 from the aperture 76 when the transverse forces exerted on end 64 by the edges of aperture 76 overcome the compression of spring 56, causing rotation of member 50, so that the end 64 of member 50 leaves aperture 76 during such rotation.

A rectangular portion of aperture 76 extends to the bottom section 72 of heel plate 70, so as to allow the heel latch assembly 46 to be put on or off of end 64 of member 50.

As best seen in FIGS. 4–6, the heel latch mechanism 78 comprises a latch 84, rotatably secured to the upper section of heel plate 70 by a pin 86 permanently secured to latch 84 and heel plate 70 through matching holes 88 in latch 84 and in heel plate 70; and a locking screw 100, which is received in a threaded hole 102 in the upper portion of heel plate 70, and locks the latch 84 in one of two positions (the shaded or unshaded configurations of latch 84 in FIG. 6) by engaging one of two recesses 104 in the surface of latch 84.

The heel latch mechanism 78 only constitutes one particular heel latch means for closing the upper portion of aperture 76; other equivalent means could instead be used.

In the downhill skiing configuration, the screw lock 20 of the front binding assembly 2 is unlocked, while the latch 84 of the heel latch mechanism 78 is locked, as shown in FIG. 2 and the unshaded orientation of latch 84 in FIG. 4, so as to hold the end 64 of member 50 of the heel binding 44 within the arch shaped upper portion 82 of aperture 76. During normal skiing the ski boot 8 will be held fixed with respect to the ski 6, even though screw lock 20 is unlocked, because heel binding 44 engages heel latch assembly 46. In the event of a fall during downhill skiing a safety release of the ski boot 8 occurs in the following manner.

Figure 7:
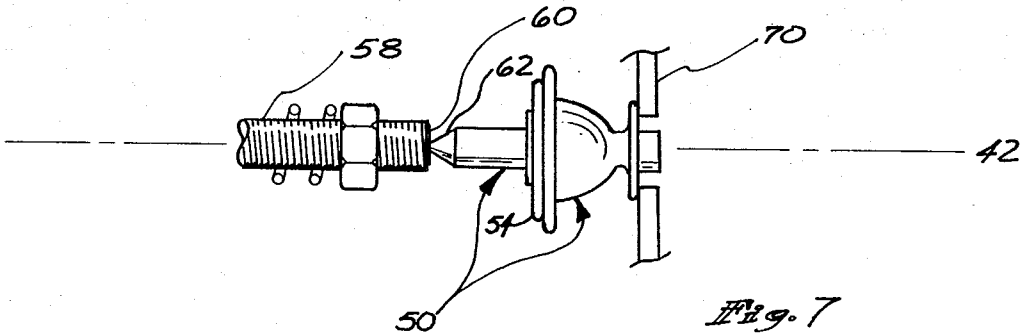
FIG. 7 is a downward view of only the indicated components, during normal skiing.
Figure 8:
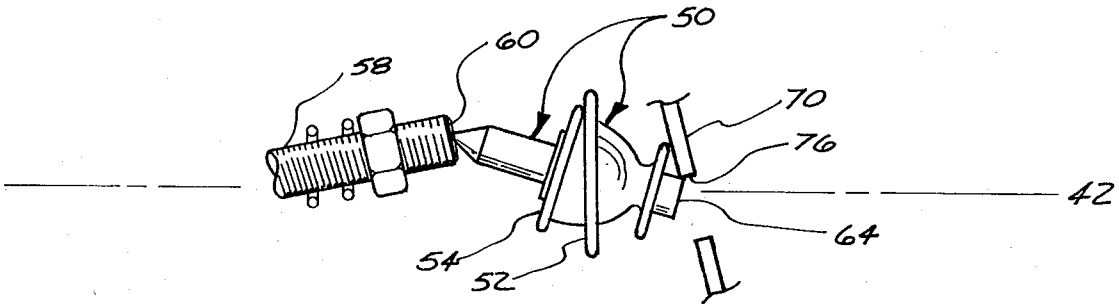
FIG. 8 is a view as in FIG. 7, during release of the heel binding.

During the fall the heel latch assembly 46 exerts a sufficient transverse (horizontal, vertical or oblique) force upon the end 64 of member 50 of heel binding 44, to overcome the compression of spring 56 of heel binding 44, allowing rotation of member 50 which removes the end 64 of member 50 from aperture 76, thus disengaging heel binding 44 from heel latch assembly 46. This release is facilitated by simultaneous rotation of ski boot 8 and heel latch assembly 46, about the center of disk 18 of the front binding assembly 2, which rotation is allowed because screw lock 20 is disengaged. In the situation shown in FIG. 1, in which the fall forces have moved the heel 48 of ski boot 8 toward the viewer, exerting a force in the same direction upon the end 64 of member 50 of the heel binding 44, it is apparent as shown in FIGS. 7 and 8 that the rotational motions of member 50 and ski boot 8 will cooperate to facilitate extraction of end 64 of member 50 from aperture 76 (In FIGS. 7 and 8 line 42 is the longitudinal axis of ski 6).

In the cross-country skiing configuration, the screw lock 20 of the front binding assembly 2 is locked, while the latch 84 of the heel latch mechanism 78 is unlocked, as shown in FIG. 3 and the shaded orientation of latch 84 in FIG. 4. In this configuration the heel 48 of ski boot 8 is free to move vertically off the ski 6, as shown in FIG. 3, as is desirable in cross-country skiing. Durng normal cross-country skiing the ski boot 8 is otherwise held fixed with respect to ski 6, by screw lock 20, toe binding 10 and heel binding 44 which restrains horizontal motion of heel 48. Horizontal release of the ski boot 8 is, however, possible by overcoming the compression of spring 56 as heretofore described, except that such release is no longer facilitated by rotation of ski boot 8, screw lock 20 being locked.

The toe binding 10 of the preferred embodiment is simply one means for binding the toe of ski boot 8 to front base plate 12 of front binding assembly 2. Numerous equivalent means could instead be used without departing from the spirit and substance of the invention.

Similarly, the heel binding 44 of the preferred embodiment is simply one means for securing the heel latch assembly 46 and the heel 48 in fixed position with respect to ski 6, and for allowing release of the heel latch assembly 46 and heel 48 when sufficient and adjustable transverse force is exerted upon such means, during a fall.

No special problems are presented by the manufacture of the present invention. The front base plate 12 and disk 18 may be manufactured by ordinary stamping and drilling techniques, in a manner well known in the art. The disk 18 may be attached to the ski 6 by screws; the toe binding 10 may also be attached by screws (or by welding) to the front base plate 12. The rear base plate 106 and braces 52 and 108 of the heel binding 44 may be formed from a single piece of metal, using conventional stamping techniques. Holes are drilled in the rear base plate 106 to allow attachment of the same to ski 6 by screws 110. The braces 52 and 108 may be formed by bending those sections of the single metal piece through a 90° angle, using conventional metalworking techniques, in a manner well known in the art. Suitable holes are drilled in braces 52 and 108 to accommodate bolt 58 and member 50. The concave end 60 of bolt 58 may be formed by applying a drill or other suitable machine tool to the end of bolt 58. The heel plate 70 of heel latch assembly 46 may be formed by stamping a single piece of metal, and bending said metal piece into a 90° angle, using conventional metalworking techniques. The latch 84 may be formed by the stamping technique. The holes 74, 88 and 102 are drilled in these pieces by standard drilling techniques. The recesses 104 in latch 84 may be formed by standard techniques using a drill, a punch, or other conventional metalworking tools.

Although aluminum parts are used in the preferred embodiment, other metals, high strength plastics, or other materials of suitable strength could instead be used, without departing from the spirit or substance of the invention.

Those familiar with the art will appreciate that various changes may be made from the specific embodiments of the invention disclosed herein, without departing from the spirit or substance of the invention. The essential substance of the invention is defined in the appended claims.

I claim:

1. Ski binding, comprising:

(a) a front base plate;

(b) rotation means, attached to said front base plate and to a ski, for securing said front base plate to said ski, and for allowing said front base plate to rotate about an axis perpendicular to the surface of said ski;

(c) toe binding means, clampable to the forward portion of a ski boot and attached to said front base plate, for binding the toe of said ski boot to said front base plate;

lock means, attached in part to said front base plate and attached in remaining part to said ski, for locking said front base plate to said ski so as to prevent rotation of said front base plate with respect to said ski;

(e) a heel latch assembly, attached to the heel of said ski boot, comprising:

(1) a heel plate, having a horizontal bottom portion attached to the bottom of the heel of said ski boot and a vertical portion behind the heel of said ski boot, said heel plate having an aperture locates principally in said vertical portion of said heel plate and extending to the rear section of the bottom portion of said heel plate;

(2) heel latch means comprising a latch rotatably attached to the vertical portion of said heel plate for selectively closing the upper portion of said aperture;

(f) heel binding means, attached to said ski and having a forwardly extending member which is adapted to be received in the upper portion of said aperture, for securing said heel latch assembly in a fixed position with respect to said ski, and for allowing release of said heel latch assembly when sufficient transverse force is applied to said heel binding means by said heel latch assembly, and for allowing adjustment of the magnitude of said transverse force required to effect said release.

2. The ski bindinag of claim 1, wherein said rotation means comprises a disk attached to said ski and a front base plate having a circular hole which surrounds and snugly fits said disk, said disk and the edges of said hole having canted edges, with diameter increasing toward the top.

3. The ski binding of claim 1, wherein said toe binding means is a standard 3-pin 75 mm. toe binding.

4. The skin binding of claim 1, wherein said lock means comprises a screw passing through a hole in said front base plate, and a lock plate attached to said ski, having a threaded hole with threads matching those of said screw, so positioned as to receive said screw when said front base plate is aligned parallel to the longitudinal axis of said ski.

5. The ski binding of claim 1, wherein said heel latch means further comprises a locking screw in a threaded hole in said vertical portion of said heel plate, and a pluraity of recesses in the surface of said latch, so positioned as to receive said locking screw when said latch is rotated under said lock screw.

6. The ski binding of claim 1, wherein said heel binding means is Cubco toe binding.

7. The ski binding of claim 1, wherein all parts of said ski binding are aluminum.

8. The ski binding of claim 1, wherein said heel plate is formed of one piece of material.

* * * * *